US005758973A

United States Patent [19]

LaFleur

[11] Patent Number: 5,758,973

[45] Date of Patent: Jun. 2, 1998

[54] BULK BAG WITH REINFORCED LIFT STRAPS

[75] Inventor: Lee LaFleur, Manistee, Mich.

[73] Assignee: Custom Packaging Systems, Inc., Manistee, Mich.

[21] Appl. No.: 751,969

[22] Filed: Nov. 19, 1996

[51] Int. Cl.[6] ..... B65D 33/02; B65D 33/14

[52] U.S. Cl. ..... 383/20; 383/24; 383/121; 493/226

[58] Field of Search ..... 383/20, 24, 121; 493/226

[56] References Cited

U.S. PATENT DOCUMENTS

| | | | |
|---|---|---|---|
| 483,402 | 9/1892 | Stivers et al. | 383/20 |
| 676,660 | 6/1901 | Mogg | 383/20 |
| 2,673,024 | 3/1954 | Kuss | 383/121 |
| 4,521,911 | 6/1985 | Vance | 383/20 |
| 4,524,457 | 6/1985 | Marino | 383/24 |
| 4,584,705 | 4/1986 | Myklebust et al. | 383/121 |
| 4,781,473 | 11/1988 | LaFleur | 383/16 |
| 4,822,179 | 4/1989 | Nattrass | 383/20 |
| 5,104,236 | 4/1992 | LaFleur | 383/17 |
| 5,340,217 | 8/1994 | Rothman | 383/24 |

*Primary Examiner*—Stephen P. Garbe
*Attorney, Agent, or Firm*—Barnes, Kisselle, Raisch, Choate, Whittemore & Hulbert, P.C.

[57] ABSTRACT

A collapsible bulk bag with lift straps is formed from a tubular blank of material severed from an elongate web of material and is provided with reinforced upper corners integral with the blank. The blank is severed from the web to provide a central portion which forms four rectilinear side walls and triangular portions preferably adjacent each end of the central portion. The adjacent sides of adjacent triangular portions at the lower end of the central portion are connected together to form a bottom of the bag. Each triangular portion at the upper end of the central portion is folded over and disposed with its base along the upper edge of two adjacent side walls and its apex generally collinear with the juncture of the adjacent side walls. Each of these triangular portions is folded down onto the bag to overlie a portion of the adjacent side walls providing a double layer of material adjacent the upper corners of the bag, where the lift straps are attached to the sidewalls and overlying triangular portions, to increase the load bearing capacity of the attachment of the lift straps to the bag and of the bag.

27 Claims, 2 Drawing Sheets

BULK BAG WITH REINFORCED LIFT STRAPS

FIELD OF THE INVENTION

This invention relate s to shipping and storage containers and more particularly to a collapsible bulk bag and a method of making it.

BACKGROUND OF THE INVENTION

Previously, many granular products have been shipped and stored in large bulk bags which may contain as much as a ton or more of material. Some of these bulk bags are flexible and when empty can be folded to a generally flat condition. One such flexible bag is disclosed and claimed in U.S. Pat. No. 5,104,236.

These flexible bags have generally rectangular ends interconnected by generally rectangular side walls and when filled can be stacked one on top of another. For some applications, the bags are preferably made of a woven fabric and for other applications, a plastic material. For some applications, and particularly for storing liquids, a liner of a water impervious plastic film is received in, reinforced and protected by a bag of woven fabric.

To facilitate lifting, moving, and filling these bags, lift straps can be attached adjacent to the side walls of the bag. When the bags are fully loaded and being carried by the lift straps, high stresses result in the bag especially at the connections between the bag and the lift straps. These high stresses can cause the bag to rupture or tear adjacent the lift straps and when lifted by the straps the bags have a tendency to tear along the lines of stitching of the threads attaching the straps to the bag, thereby destroying the bag and spilling its contents.

SUMMARY OF THE INVENTION

According to the present invention, collapsible bags have reinforced areas adjacent to the connection between each lift strap and the bag. Preferably, the bags are produced from an elongate web of flexible material which is severed to produce a plurality of substantially identical blanks with little if any waste material between adjacent blanks. When filled, the bags of this invention preferably have a substantially square bottom interconnected by four generally rectangular side walls which are all part of the same blank of flexible material and when empty can be folded into a flat and compact arrangement having a pair of overlying panels of generally hexagonal configuration with a pair of folded gusseted panels received therebetween.

Preferably, each blank has a central portion and four generally triangular portions adjacent each end of the central portion and integral therewith. The sides of each triangular portion extend from the central portion toward the apex of the triangular portion. Adjacent sides of the triangles adjacent the bottom of the central portion are connected together along a line extending from the central portion to their associated apexes to provide, when the bag is filled, a generally square bottom with four generally rectangular side walls extending therefrom.

To provide reinforcement adjacent the upper corners of the bag, the triangular portions extending from the upper edge of the central portion are folded down onto the bag, preferably with the apex of each triangular portion adjacent to and generally collinear with the juncture between corresponding adjacent side walls of the bag. This provides a double thickness of material adjacent each of the upper corners of the bag to which the lift straps are attached and thus, increases the load bearing capacity of the bag.

Objects, features and advantages of this invention are to provide a collapsible bag and method of making it which provides reinforcement adjacent the lift straps of the bag, maximizes the load bearing capacity while minimizing the quantity, weight and cost of fabric material of the bag, is produced substantially without waste material, is readily and easily adapted to the mass production of bags, and is of relatively simple, economical and reliable construction and manufacture of bags.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
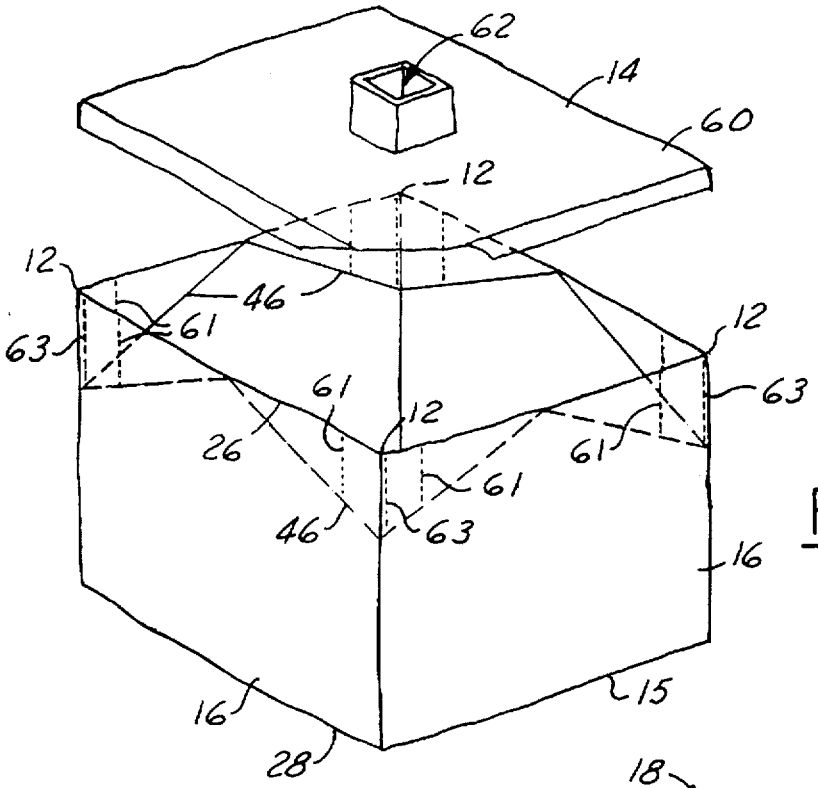
FIG. 1 is perspective view of a bag having reinforced upper corners according to the present invention.

Referring in more detail to the drawings, FIG. 1 shows a collapsible bulk bag 10 formed with reinforced upper corners 12 according to the present invention. The bag 10 is made from a blank which is cut or severed from an elongate web of a flexible material and when expanded or filled, the bag 10 has a pair of generally square top and bottom walls 14, 15 interconnected by four generally rectangular side walls 16. For applications where containers or bags 10 of great strength are needed, they may be made from a woven fabric material, such as woven polyethylene and woven polypropylene fabrics. For other applications where less strength is needed or a leak proof container is required, the bags 10 may be made from a plastic film such as polyethylene and polypropylene plastic films with a thickness in the range to about 4 to 10 mil. If a leak proof and high strength container is required, a bag 10 or liner of a plastic film can be received in a bag 10 of a woven fabric with both bags having the same general configuration.

Figure 2:
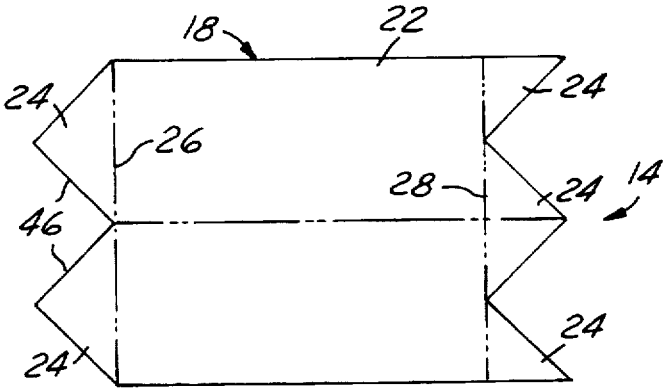
FIG. 2 is a plan view of a blank folded and severed for making the bag of FIG. 1.

As shown in FIG. 2, preferably the body of the bag is made from a cut blank 18 having a tubular or circumferentially continuous central portion 22 and at least two and preferably four triangular portions 24 extending from the upper edge 26 and integral with the central portion 22. Preferably, the central portion 22 also has four triangular portions 24 adjacent and extending from its bottom edge 28 which, when these adjacent triangular portions 24 are connected to each other along their adjacent sides, form a generally square bottom 15 of the bag 10. If the blank 18 is made of a woven fabric material, preferably the triangular portions 24 are connected together by a series of stitches with a suitable thread and if the material is a plastic film preferably by heat sealing the triangular portions 24 together.

If desired, blanks 18 can be cut from an elongate sheet of a single layer of flexible material and then their side edges connected or joined together to provide a tubular blank 18. However, preferably the blanks 18 are cut from a tubular web 20, which is circumferentially continuous. Preferably, the tubular web 20 is seamless, although it can be formed by connecting or joining together the side edges of an elongate sheet of flexible material, such as by stitching a woven fabric or heat sealing a plastic film.

Figure 3:
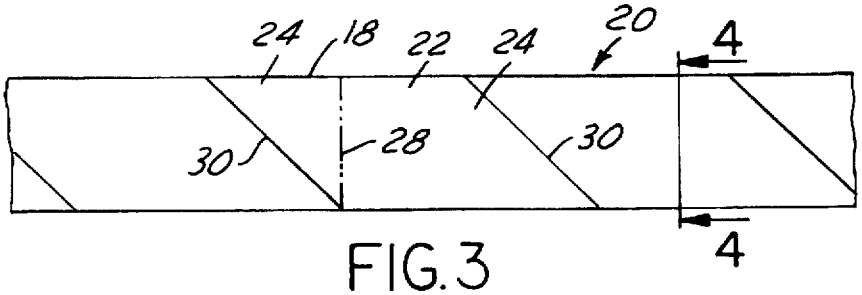
FIG. 3 is a fragmentary plan view of a web of material after it has been folded twice about its longitudinal axis to simplify cutting a blank for making the bag.
Figure 4:
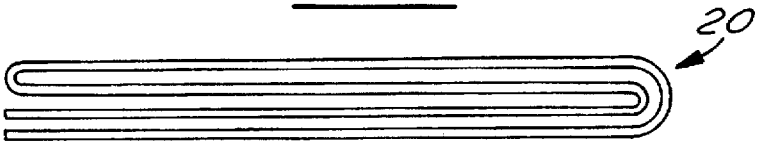
FIG. 4 is a sectional view of the web taken on line 4—4 of FIG. 3.

As shown in FIG. 3, a plurality of substantially identical blanks 18 can be severed or cut from a web 20 substantially without wasting any material between adjacent blanks 18. To simplify cutting the tubular web 20 and improve the accuracy of the cut blanks 18, it is desirable to fold the web 20 once, and preferably twice, as shown in FIGS. 3 and 4. If the tubular web 20 is folded over itself once it will have four layers of material which can be cut at the same time along a generally V-shape segment of lines. If the tubular web 20 is folded over itself twice, there will be eight layers of material (FIG. 4) which can be cut at the same time along straight and parallel lines 30 which form the sides of the triangles 24 adjacent the upper 26 and lower edges 28 of the central portion 22.

Figure 5:
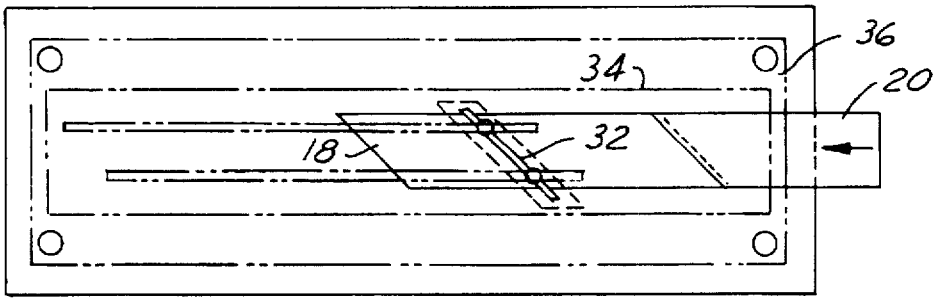
FIG. 5 is a fragmentary plan view of the web of FIG. 2 received in a severing apparatus.

As shown in FIG. 5, when the web 20 has been folded twice it can be readily severed by a straight knife edge 32 carried by a movable upper platen 34 of a fixture 36 received in a conventional press. The twice folded web 20 is advanced through the fixture 36 a distance equal to the desired length of the blanks 18, so that with each cycle of the press the knife edge 32 cuts one blank 18 from the web 20. More preferably, two knife edges are disposed on a fixture 36, such that two blanks 18 are severed at the same time. When severed accordingly and unfolded, each blank 18 has the general configuration shown in FIG. 2.

Figure 6:
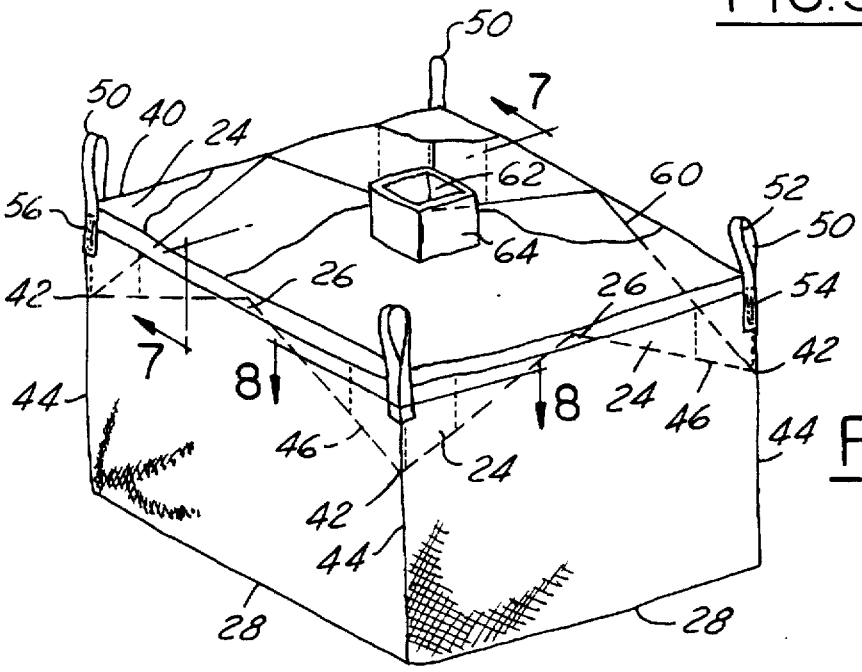
FIG. 6 is a fragmentary perspective view of a collapsible bag having lift straps attached to the bag adjacent to the reinforced upper corners of the bag.

As shown in FIG. 6, the bag 10 has four side walls 16 that extend generally transversely of and upward from the bottom wall 15 which is formed by connecting together the adjacent side edges of all of the triangles 24 adjacent the lower edge 28 of the blank 18.

Figure 7:
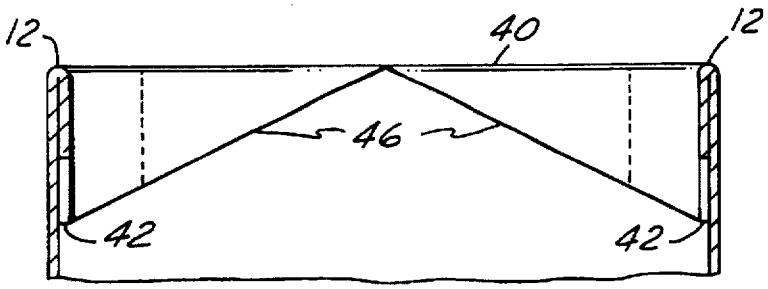
FIG. 7 is a sectional view of a side wall of a bag taken along line 7—7 of FIG. 6.

The triangular portions 24 adjacent the upper edge 26 of the central portion 22 of the blank extend from the side walls 16 with the base 40 of each triangle 24 overlying a portion of the upper edges 26 of adjacent side walls 16 and the apex 42 of the triangle 24 extending upwardly from the side walls 16 with the apex 42 of each triangle 24 being generally collinear with the juncture 44 of the adjacent side walls 16. Preferably, one triangular portion 24 extends from the central portion 22 adjacent each upper corner 12 of the bag 10. Each of these triangular portions 24 is then folded along its base 40 so that it overlies a portion of its adjacent side walls 16 and has its apex 42 generally collinear with the juncture 44 of the adjacent side walls 16. When folded in this manner, the triangular portions 24 provide a second layer of material adjacent each of the upper corners 12 of the bag 10 as indicated by the phantom lines 46 in FIGS. 1 and 6 and as shown in FIG. 7.

Figure 8:
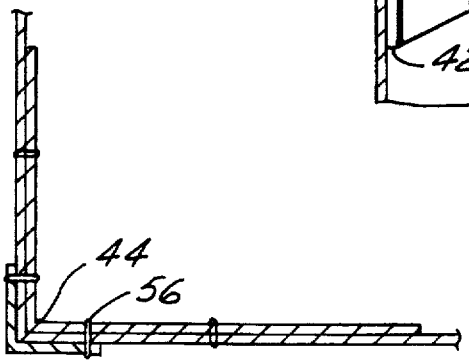
FIG. 8 is a sectional view of an upper corner of the bag.

As also shown in FIG. 6, to facilitate lifting and moving the bag, lift straps 50 are provided adjacent at least two upper corners 12 of the bag 10, and preferably, adjacent all four upper corners 12 of the bag 10. Preferably, each strap 50 is in the form of a loop 52 of a flexible material with its legs 54 connected to adjacent side walls 16 of the bag 10 immediately adjacent an upper corner 12 of the bag 10 and through an adjacent triangular portion 24 by a series of stitches 56 of a suitable thread as shown in FIG. 8. Thus, the triangular portions 24 adjacent the upper corners 12 of the bag 10 provide reinforcement adjacent the lift straps 50 of the bag 10 to increase the load bearing capacity of the bag 10. A preferred construction and attachment of the lift straps to the bag is disclosed in U.S. Pat. 4,781,473 which is incorporated herein by reference and hence will not be described in greater detail.

When constructed in this manner, the top 14 of the bag 10 is open. If desired, a top wall 60 of a separate piece of material can be connected adjacent the upper edge 26 of the side walls 16 of the bag as shown in FIGS. 1 and 6. In this instance, an access opening 62 is preferably provided in the top wall 60 of the bag 10 to facilitate filling the bag 10. Also preferably, a spout 64 is provided in the access opening 62 and is closeable to seal the bag 10. Similarly, to facilitate emptying the bag 10 a closeable opening and/or spout can be provided in the bottom wall 15 of the bag 10.

When the bag 10 is filled, it assumes a generally rectangular or cubical configuration preferably with generally square ends 14, 15 and four interconnecting side walls 16 each of which is generally rectangular. Further, the side walls 16 and the attachments of the lift straps are reinforced with a second layer 24 of material adjacent the upper corners 12 of the bag 10 thereby increasing the load bearing capacity of the bag 10 and the lift straps 50. Still further, bags 10 of this invention are formed substantially without producing any waste material of the web 20 when the blank 18 of each bag 10 is severed from the web 20 and further minimizes the amount of material necessary to form the bag 10 by strategically locating reinforcement of the bag 10 only adjacent the lift straps 50 of the bag 10, where the highest stresses occur during lifting and moving of the bag 10.

I claim:

1. A collapsible bag comprising:

a plurality of rectilinear side walls formed from a single piece of a circumferentially continuous blank of material and having generally opposed upper and lower edges;

a triangular portion integral with the lower edge of each side wall;

a bottom adjacent the side walls formed by connecting adjacent side edges of adjacent lower triangular portions;

at least two upper triangular portions integral with and folded over the upper edge of the side walls, overlapping a pair of adjacent side walls and disposed with the base of each upper triangular portion adjacent the upper edge of the pair of adjacent side walls with the apex of each upper triangular portion generally collinear with the juncture of the pair of adjacent side walls; and at least two lift straps each attached to the bag through a side wall and an adjacent upper triangular portion whereby the upper triangular portions provide reinforcement of the bag adjacent the lift straps.

2. The bag of claim 1 which comprises four upper side walls and four triangular portions each adjacent to the upper edge of a pair of adjacent side walls so that one upper triangular portion is disposed adjacent each upper corner of the bag.

3. The bag of claim 2 wherein each lift strap is attached to the bag through a separate upper triangular portion.

4. The bag of claim 1 wherein the bottom is formed from four triangular portions each integral with and extending from the bottom edge of a side wall with adjacent sides of the adjacent triangular portions connected together to form a generally rectangular bottom wall.

5. The bag of claim 1 wherein two triangular portions are disposed adjacent generally diagonally opposed upper corners of the bag and a separate lift strap is attached through each triangular portion.

6. The bag of claim 1 which also comprises a top attached to the bag adjacent the upper edge of the side walls of the bag.

7. The bag of claim 6 which also comprises a spout in the top to facilitate filling the bag.

8. The bag of claim 1 wherein the lift straps are attached by a series of stitches of a thread.

9. A method of making a plurality of collapsible bags comprising the steps of:

a.) forming from an elongate web of flexible material a plurality of tubular blanks, each blank having a circumferentially continuous central portion having generally opposed upper and lower edges and at least two lower triangular portions adjacent the lower edge thereof and at least two upper triangular portions adjacent the upper edge of the central blank, each of the lower and upper triangular portions integral with the central portion;

b.) forming the central portion into a plurality of rectilinear side walls with each upper triangular portion adjacent a pair of adjacent side walls with the apex of each upper triangular portion substantially collinear with the juncture of the adjacent side walls; p1 c.) folding over the upper edge of the adjacent side walls the upper triangular portions so that each overlies the adjacent side walls with the apex of each upper triangular portion substantially collinear with the juncture of the adjacent side walls;

d.) forming a bottom wall of the bag by connecting together adjacent side edges of adjacent lower triangular portions; and e.) attaching lift straps to the bag through a side wall and an adjacent upper triangular portion.

10. The method of claim 9 wherein a plurality of bags are formed substantially without producing any waste material of the web between adjacent ends of adjacent blanks by severing the web along a path having substantially straight segments defining the sides of the upper and lower triangular portions.

11. The method of claim 9 wherein said central portion is formed into four rectilinear side walls and the bottom wall is generally rectangular.

12. The method of claim 11 wherein said bottom wall is formed of four lower triangular portions having a base and two sides that are integral with the central portion with the base of each along the lower edge of an adjacent side wall and which are connected together along their adjacent sides to form a bottom wall.

13. The method of claim 9 wherein four upper triangular portions are provided with one adjacent each upper corner of the bag.

14. The method of claim 13 wherein one lift strap is attached to the bag and through each upper triangular portion and an adjacent side wall portion.

15. The method of claim 9 which also comprises providing the web in the form of an elongate and circumferentially continuous tube of flexible material before severing the blanks and having a configuration with two generally flat and overlying layers of material when severing them to form the blank.

16. The method of claim 9 which also comprises provided the web in the form of the elongate and circumferentially continuous tube of flexible material before severing the web to form the blanks and having four generally flat and overlying layers of material when severing them to form the blanks.

17. The method of claim 9 which also comprises providing the web in the form of elongate and circumferentially continuous tube of flexible material before severing the web to form the blanks and having a configuration with eight generally flat and overlying layers of material when severing them to form the blanks.

18. The method of claim 17 wherein the eight overlying layers are severed along a straight line across the entire width of the folded tube by the same severing means.

19. The method of claim 18 wherein each blank is formed by severing all eight layers of the web along straight and parallel lines across the entire width of the folded tube forming the upper and lower edges of the blank.

20. The method of claim 9 which also comprises providing a top and attaching the top to the side walls.

21. The method of claim 20 which also comprises providing a spout in the top to facilitate filling the bag.

22. A collapsible bag comprising:

a plurality of side walls formed from a single piece of a circumferentially continuous blank of material and having generally opposed upper and lower edges;

a bottom adjacent the lower edge of the side walls and connected to the side walls;

at least two upper triangular portions homogeneously integral with the side walls and folded over the upper edge of a pair of adjacent side walls with the base of each disposed along and integral with at least a portion of the upper edge of the pair of adjacent side walls and the apex of each generally collinear with the juncture of the pair of adjacent side walls, each triangular portion folded along its base and overlapping a portion of each of the pair of adjacent side walls; and at least two lift straps each attached to the bag through a side wall and an adjacent triangular portion whereby the triangular portions provide reinforcement of the bag adjacent the lift straps.

23. The bag of claim 22 which comprises four side walls and four upper triangular portions each adjacent to the upper edge of a pair of adjacent side walls so that one triangular portion is disposed adjacent each upper corner of the bag.

24. The bag of claim 23 wherein a lift strap is attached to the bag through each triangular portion.

25. The bag of claim 22 wherein the bottom is formed from four lower triangular portions each integral with and extending from the bottom edge of a side wall with adjacent sides of the adjacent lower triangular portions connected together to form a generally rectangular bottom wall.

26. The bag of claim 25 wherein the base of each lower triangular portion forming the bottom wall is coextensive with the lower edge of a side wall.

27. The bag of claim 22 wherein two upper triangular portions are disposed adjacent generally diagonally opposed upper corners of the bag and a separate lift strap is attached through each upper triangular portion.

* * * * *

UNITED STATES PATENT AND TRADEMARK OFFICE

CERTIFICATE OF CORRECTION

PATENT NO. : 5,758,973

DATED : June 2, 1998

INVENTOR(S) : Lee LaFleur

It is certified that error appears in the above-indentified patent and that said Letters Patent is hereby corrected as shown below:

Col 4, Line 61, after "four" delete "upper".

Col 4, Line 62, after "four" insert "upper".

Col 5, Line 6, after "two" insert "upper".

Col 5, Line 32, after "walls;" delete "pl" and begin a new paragraph with clause "c.)".

Col 6, Line 4, change "provided" to "providing".

Signed and Sealed this

Twenty-ninth Day of September, 1998

*Attest:*

*Attesting Officer*

Bruce Lehman

BRUCE LEHMAN

*Commissioner of Patents and Trademarks*